United States Patent [19]

Decker et al.

[11] 3,998,382

[45] Dec. 21, 1976

[54] MECHANISM FOR DEGASIFICATION OF A VISCOUS LIQUID BY MEANS OF CENTRIFUGAL ACTION

[75] Inventors: Hanns Decker, Cologne; Willy Jakobs, Porz-Grengel, both of Germany

[73] Assignee: Klockner-Humboldt-Deutz AG, Germany

[22] Filed: Nov. 1, 1974

[21] Appl. No.: 520,015

[52] U.S. Cl. ..... 233/7; 233/24; 233/19 R; 233/47 R

[51] Int. Cl.[2] ..... B04B 1/12; B04B 11/04

[58] Field of Search ..... 233/1 R, DIG. 1, 1, 233/3, 7, 17, 18, 23 R, 27, 47 R, 28, 21, 22, 24; 55/41, 45, 203

[56] References Cited

UNITED STATES PATENTS

| | | | |
|---|---|---|---|
| 785,910 | 3/1905 | Nilsson | 233/7 |
| 802,473 | 10/1905 | De Raasloff | 233/7 |
| 2,634,907 | 4/1953 | Smith | 55/203 X |
| 2,648,496 | 5/1953 | Cresswell | 233/22 |
| 2,753,010 | 7/1956 | Walther | 233/27 |
| 3,856,483 | 12/1974 | Rumpf | 55/203 X |

*Primary Examiner*—George H. Krizmanich
*Attorney, Agent, or Firm*—Hill, Gross, Simpson, Van Santen, Steadman, Chiara & Simpson

[57] ABSTRACT

In a method of degasification of viscose liquids by means of centrifugation the liquid is brought onto the interior wall of a rotor in the form of a flowing film and divided into a bubble-poor and a bubble-rich portion, the bubble-poor portion being separated from the bubble-rich portion prior to leaving the rotor and withdrawn from the rotor wall by means of at least one pump. In a preferred form of the invention the bubble-rich portion of the liquid is also withdrawn separately from the centrifuge by means of at least one pump and returned for renewed centrifugation. The invention includes a centrifuge for carrying out the method.

15 Claims, 7 Drawing Figures

Figure 3:
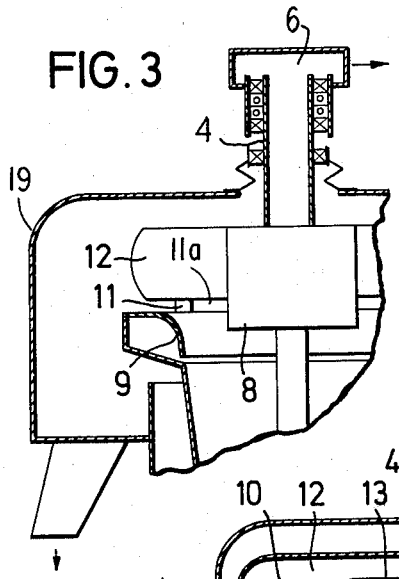

6
4
19
12
11a
11
9
8

III
12
10
11
17
14
15
8

6
4
10
12
13
14
II
11
8
7'
7
9'
15
9
19
16
17
1
2
3
5
18
VARIABLE SPEED MOTOR

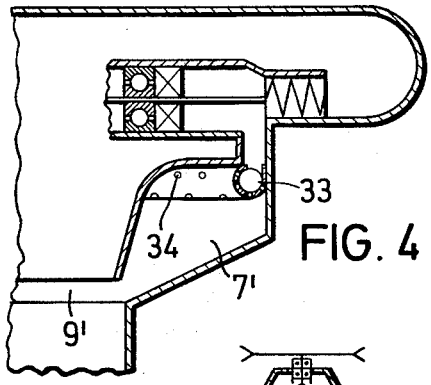
FIG. 4
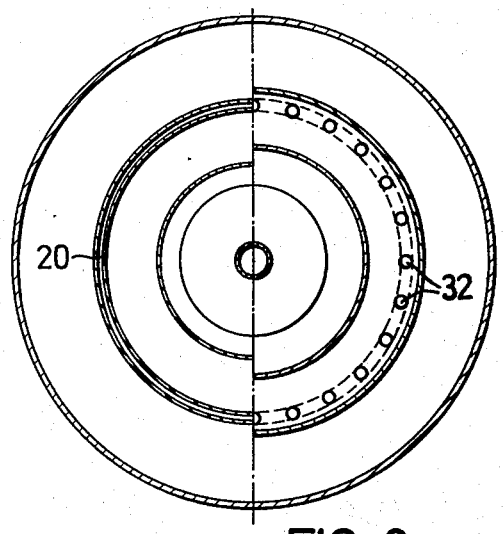
FIG. 6
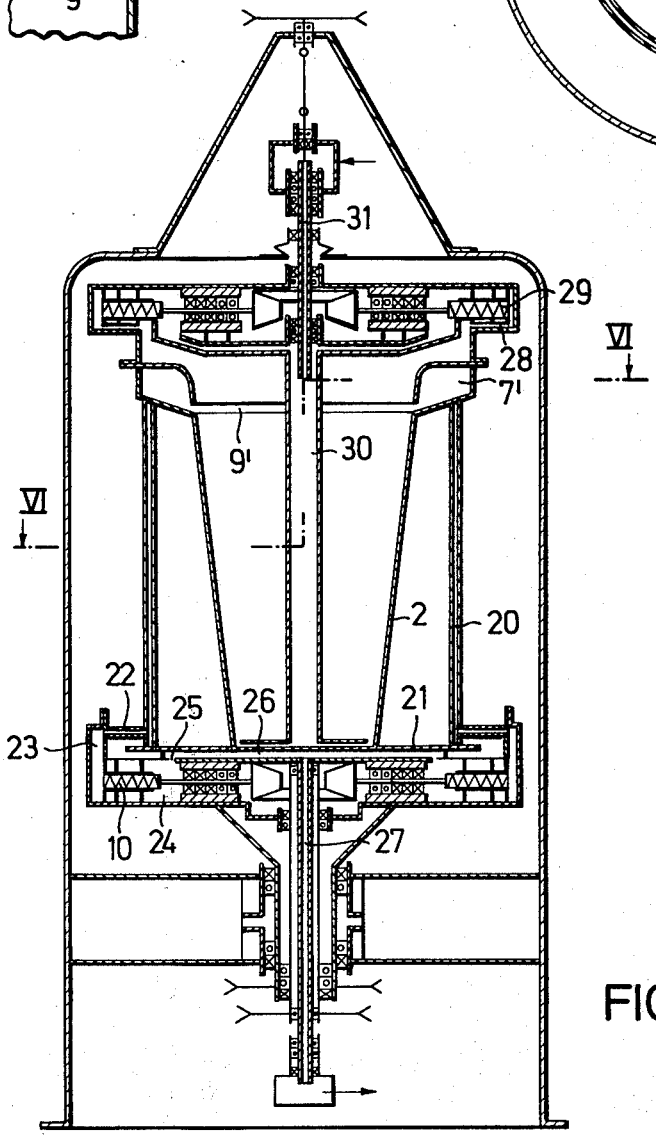
FIG. 5
FIG. 7
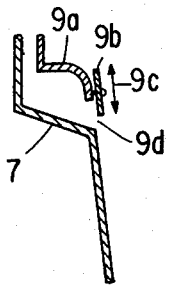

MECHANISM FOR DEGASIFICATION OF A VISCOUS LIQUID BY MEANS OF CENTRIFUGAL ACTION

This invention relates to a method of degasification of a viscose liquid by means of centrifugation, according to which method the liquid to be degassed is brought onto the interior wall of a rotor in the form of a flowing film and divided into a bubble-poor and a bubble-rich portion, the bubble-poor portion being separated from the bubble-rich portion prior to leaving the rotor.

From the published German patent application No. 2,300,231 a method of removing air from fats is known in which the fat to be freed from air, which constitutes a highly viscose liquid, through an annular channel at one end of a rotor is forced under pressure into the interior of said rotor. Hereby the fat is distributed in the form of a thin film on the inner wall of the fast rotating rotor and flows due to the continuous further fat input in the direction toward the other end of the rotor. In the region of the effluent end of the rotor there is provided within said rotor a stationary disc which is so dimensioned that between the inner wall of the rotor and the outer rim of the disc only a narrow slot or gap remains which has a width on the dimensional order of the thickness of the liquid film. The stationary disc is further provided with a plurality of radial channels which extend inwardly to a central, axially extending collection conduit. After extensive destruction of the air bubbles in the fat due to the strong centrifugal forces the degassed fat is under the influence of the succeeding fat quantities supposed to pass through the radial channels in the stationary disc into the collection conduit and to be drawn off therefrom.

An essential disadvantage of this method and the device required therefor consists in the fact that the product to be degassed is subjected to heavy shearing forces in the juncture region between the fast rotating rotor and the stationary disc. It is true that this may be permissible in the case of lubrication fats. It is, however, not permissible for sensitive liquids, particularly highly viscose liquids, since in such cases the friction, and therewith the shearing action, within the liquid at the effluent place becomes so intense as to tend to cause chemical changes in the liquid. Another disadvantage of the known method is that in no way can influence be exerted on the separation layer if the bubbles accumulating on the surface of the liquid film due to the centrifugal force are not destroyed but rather float around in form of a foam upon the practically completely degassed portion of the liquid in direct contact with the rotor wall.

It is the object of the invention to provide a method with the aid of which a desired and in case of need controllable drawing-off of the liquid from the centrifuge rotor can be effected. This is according to the invention accomplished by drawing off at least a portion of the liquid, preferably the bubble-poor portion of the liquid, by means of at least one pump from the rotor circumference. This has the advantage that through a predeterminable relation of the influent quantity to the portion of the liquid drawn-off by the pump it can be ensured that only the bubble-poor portion of the liquid is removed from the rotor, and at the same time that a renewed gasification of said portion of the liquid is avoided. The bubble-rich portion can in the usual way be flung by the centrifuge rotor into an outlet housing, or else it can in an advantageous form of the inventive method, also by means of at least one pump, be drawn-off from the rotor circumference and again pumped back into the cycle at the inlet end.

In an advantageous embodiment of the invention it is provided that the control of the separation layer between the bubble-poor and the bubble-rich portions of the liquid takes place through regulation of the pump effect. This feature has the advantage that during the operation said separation layer can be varied, so that the output of bubble-poor liquid can be adjusted to an optimal value.

The invention relates further to a centrifuge for carrying out the inventive method, with a liquid inlet at one end and liquid outlet means for the separate discharge of the bubble-poor and the bubble-rich portions of liquid at the other end of the centrifuge rotor, and said centrifuge is characterized by the fact that at least one pump is connected with the centrifuge rotor, said pump having its suction side in communication with the interior of the rotor. The advantage of this arrangement is that, in addition to a controllable drawing-off of the degassed portion of the liquid from the centrifuge rotor, during said drawing-off renewed gasification is avoided, such as would result for example from the turbulence in the case of stationary scoop tubes or buckets.

In carrying out the invention it is further provided that at the outlet end of the rotor at least one accumulation chamber is secured which extends around the entire circumference of the rotor and is in communication with the interior of the rotor, the suction side of the pump being in communication with said accumulation chamber. Through this accumulation chamber a certain cushioning for the output quantity is achieved and in addition the passage to the pump of the liquid to be withdrawn is substantially simplified, since larger cross-sections of the required influent openings of the pump may be selected without detrimental effect upon the separation of bubble-poor and bubble-rich portions within the centrifuge rotor.

In a particularly advantageous embodiment it is provided that the pump is constructed as a worm or screw pump. This offers particularly the advantage that besides a structurally simple design which is easy to assemble and consequently to clean, the liquid to be pumped is also only to a minor extent subjected to shearing stresses, so that also in this respect sensitive liquids can be degassed.

Figure 2:
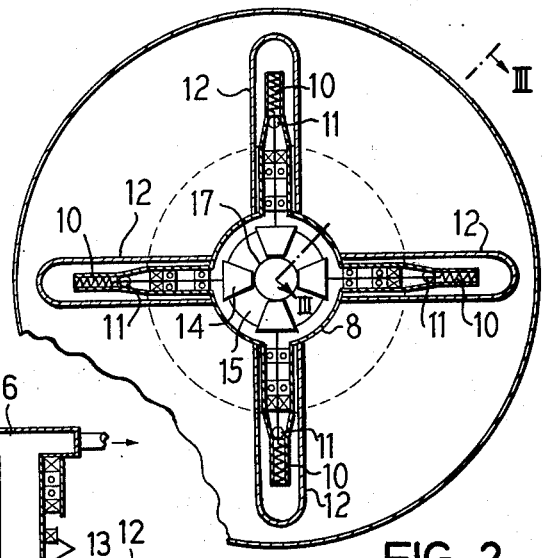

The invention will now be described in greater detail with reference to the accompanying drawings diagrammatically showing an embodiment of the invention. In said drawings FIG. 1 shows a vertical section through a centrifuge according to the invention, FIG. 2 shows a horizontal section on line II—II of FIG. 1, FIG. 3 shows a partial vertical section on line III—III of FIG. 2, FIG. 4 shows a vertical section of a different embodiment of the connection between accumulation chamber and pump, FIG. 5 shows a vertical section of a further inventive embodiment of the centrifuge, FIG. 6 shows a cross-section along line VI—VI in FIG. 5;

FIG. 7 is a fragmentary enlarged sectional view showing a mechanism for an adjustable gap.

Figure 1:
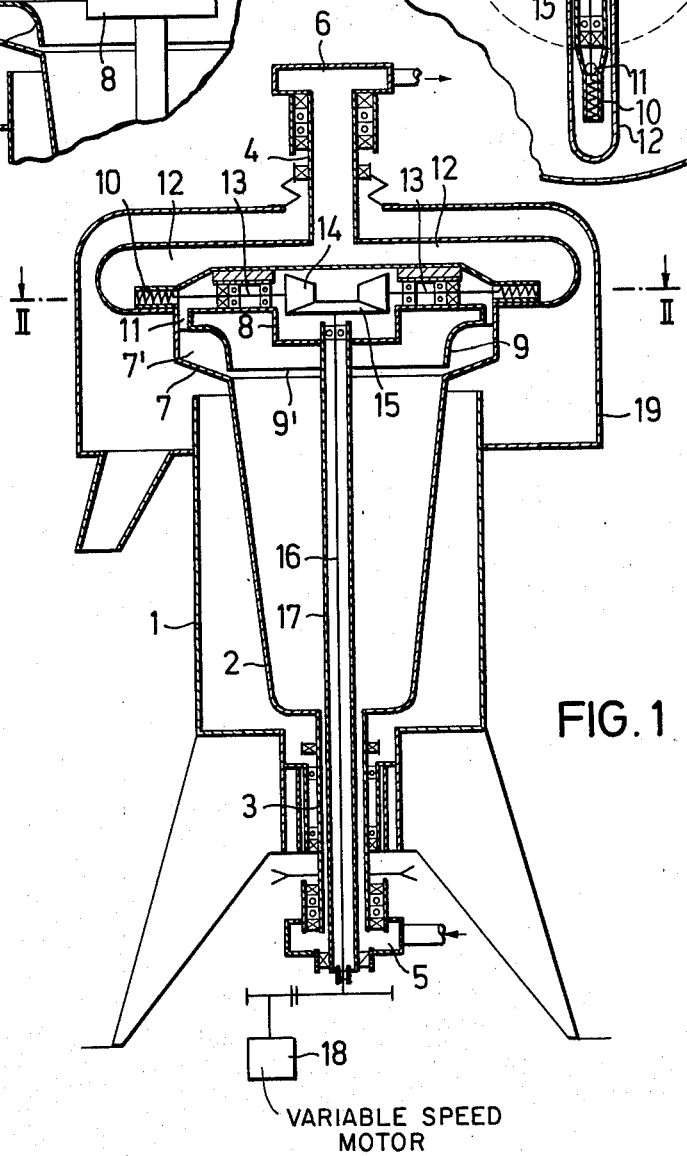

In FIG. 1, a centrifuge rotor 2 is rotatably journaled in a stationary housing 1 by means of hollow shaft members 3 and 4. The shaft member 3 communicates with a supply means 5 for the liquid to be degassed, and the shaft member 4 is in communication with an outlet means 6 for the degassed liquid. The centrifuge rotor preferably widens slightly conically from the inlet end and has in the region of the outlet end an abrupt enlargement 7.

At the outlet end there is coaxially secured to the centrifuge rotor an axially adjustable annular deflection plate 9 which extends across the enlargement 7 of the centrifuge rotor and thus forms an annular accumulation chamber 7′ which is connected with the interior of the rotor over the annular slot or gap 9′ remaining between the deflection plate 9 and the edge of the enlargement 7.

As shown in FIG. 2, at the outlet end of the centrifuge rotor there are provided in a cross-shape, and to the rotor secured housing 8 four symmetrically arranged screw pumps 10 which through axially extending channels 11 have their intake in communication with the annular accumulation chamber 7′. The radially outwardly delivering pumps are each connected with a radially inwardly extending return channel 12 which communicates with the hollow shaft member 4.

The operation of the screw pumps is effected by radially extending shafts 13 which are driven by a centrally disposed drive shaft 16 in the rotor by a bevel gear assembly 14, 15. The central drive shaft 16 is journaled in a shielding tube 17 that is fixedly secured to the rotor, and said drive shaft 16 is connected with a diagrammatically indicated drive means 18 which preferably is regulatable in rotary velocity. Through this advantageous arrangement a plurality of pumps may be driven by a single drive means.

As shown in FIG. 3, the housing 8 with the return channels 12 connected therewith is in relation to the open end of the centrifuge rotor so arranged that also in the region of the housing 8 an outlet gap remains.

In operation of the centrifuge the liquid to be degasified, for example silicone oil, is introduced through the supply means 5 into the centrifuge rotor. Here the liquid spreads out in the form of a thin film on the wall of the rotor and flows in the direction of the outlet end. The minute and most minute gas bubbles in the liquid are under the influence of the centrifugal acceleration, for example on the order of 5g, and are separated from the liquid in such a manner as to form in the neighborhood of the wall a bubble-poor portion of the liquid and floating thereon a bubble-rich portion of the liquid.

Upon completion of the introduction phase, the amount of bubble-poor portion which enters the chamber 7′ depends upon the adjusted width of the passage gap 9′. The drive means 18 may be adjusted to control the capacity of the pumps 10 to handle the amount of bubble-poor portion reaching the pumps up through the passages 11. The bubble-rich portion of the liquid which flows upwardly and over the outwardly curved surfaces of the deflection plate 9 is flung outwardly into the outlet housing 19 that surrounds the outlet end of the rotor.

FIG. 3 illustrates the mechanism in section from which it may be seen that there is a separate flow path for each of the bubble-rich and the bubble-poor portions. The bubble-poor portion will flow into the gap below the lower edge of the curved deflector plate 9 so that it can flow into the space shown at 7′ in FIG. 1 and up through the passages 11 of FIGS. 1 and 3 to reach the pumps 10. The path for the bubble-rich portion is upwardly over the circumferential inner surface of the curved deflector plate 9 and through the spaces 11*a* between the passage channels 11. This bubble-rich portion after flowing out through the spaces 11*a*, flows into the outer housing 19.

FIG. 7 illustrates a construction for the deflector plate 9 which permits varying the size of the gap for the bubble-poor portion of the liquid. The plate 9*a* has an annular ring 9*b* secured thereto which may be moved up and down in the direction indicated by the arrowed line 9*c* thereby varying the size of the gap 9*d*.

Through the four screw pumps the bubble-poor portion of the liquid is forced into the return channel 12 and through the hollow shaft member 4 into the outlet means 6 from where it may be passed in any suitable manner. Through a change of the rotary speed of the drive motor 18 the delivery capacity of the pumps may be influenced during the operation, and thereby the separation section between the bubble-poor and bubble-rich portions of the liquid may be accurately adjusted in correspondence to the requirements on the degassed portion of the liquid.

In FIG. 4 a further inventive development of the outlet region for the bubble-poor portion of the liquid from the accumulation chamber 7′ is shown. In this embodiment in both circumferential directions from a passage channel 11 extends a feed pipe 33 with inlet openings 34 being in communication with said passage channel 11. This feed pipe may extend annularly through the entire accumulation chamber and be provided with communication openings corresponding to the number of the passage channels 11 or the pumps, respectively. The term "end of the feed pipe" refers in this instance to the plane which has the same distance from two adjacent passage channels. The cross-sectional area of each feed pipe increases from said "end of the feed pipe" to the region of the passage channel connection in order to achieve a uniform discharge through the pumps over the entire rotor circumference through the gap 9′. Such equalization of the liquid output may also advantageously be achieved by decreasing the size of the passage openings 34 from the end of the feed pipe 33 in the direction toward the pump in each case.

In the case of highly viscose liquids it is, as distinguished from the embodiment described above, of advantage to provide in connection with the deflector plate 9 a second annular accumulation chamber which, in turn, is in communication with a suitable number of pumps. In this way it is feasible to withdraw from the centrifuge also viscose liquids which with regard to their bubble-rich portion are not even capable of forming drops. The withdrawal of the bubble-rich portion of the liquid may be accomplished over a suitably constructed shaft member 4 which consists of two coaxial tubes, one within the other, having the inner tube connected with the return channels 12 and the outer tube connected with the corresponding return channels of the pumps for the bubble-rich portion of the liquid. The lastmentioned return channels can, for example, lead to the supply means 5 or pass the bubble-rich portion of the liquid to an additional, post-coupled centrifuge.

Incidentally, the subject matter of the invention is not limited to the described upright arrangement of such a centrifuge. In a similar manner the centrifuge may also be arranged in a lying position. The described screw pumps constitute a particularly advantageous embodiment, but with principally similar drive means piston pumps, gear wheel pumps, etc., may also be utilized.

In FIG. 5 a particularly advantageous embodiment of the inventive centrifuge is illustrated. In this embodiment the centrifuge rotor 2 is surrounded by a connection channel 20 which at its upper end is in communication with the accumulation chamber 7'. The lower end of said connection channel 20 is closed by means of a disc 21 secured to the centrifuge rotor. Below said disc 21 for example four symmetrically arranged pumps 10 are disposed which pump the liquid in the inwardly direction. Over outlet channels 22 the suction side 23 of the pumps is in communication with the connection channel 20. The pressure side 24 communicates over a passage channel 25 with an accumulation chamber 26 which is disposed below the disc 21 and from which the bubble-poor portion of the liquid can be centrally withdrawn through an axially arranged withdrawal pipe 27.

The bubble-rich portion of the liquid withdrawn over the deflection plate 9 is over radially outwardly extending channels 28 and pumps 29 pumped back into the centrifuge rotor through a middle pipe 30 which has its outlet end at the bottom of the centrifuge rotor. A supply conduit 31 for the liquid to be degassed extends from above into said middle pipe 30.

An essential advantage of this embodiment is that along the passage path, particularly for the bubble-poor portion of the liquid, no cavities exist in which air or gas cushions can be formed, but that the withdrawal from the centrifuge after the separation proceeds without any contact with air or gas. Another advantage is that through the arrangement of the pumps for the bubble-poor portion of the liquid at the lower end of the rotor a longer passage way is obtained. Even with only two pumps the pressure differences are equalized over the rotor circumference to the passage openings 32 of the accumulation chamber 7', so that a practically uniform withdrawal of the liquid from said accumulation chamber 7' results. Along the circumference of the centrifuge rotor a uniform withdrawal of the bubble-poor portion of the liquid close to the wall is thus obtained through the separation gap 9'.

In FIG. 6 there is further illustrated the fact that with the connection channel 20 between the upper annular chamber 7' and the lower pumps 10 an annular chamber is obtained which over a plurality of passage openings 32 is in communication with the accumulation chamber 7'.

The invention is not restricted to the detail features shown and described except as defined by the attached claims.

We claim as our invention:

1. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communicaton with the interior of said rotor;

means at the outlet end of said rotor forming a circumferential accumulation chamber in communication with the interior of said rotor and with the suction side of said pump; and a feed pipe in communication with the suction side of said pump having a portion of its surface within said accumulation chamber with said surface portion being provided with a plurality of passage openings.

2. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communication with the interior of said rotor; and means forming a circumferential accumulation chamber at the outlet end of said rotor, said accumulation chamber being connected with the interior of the rotor and with the suction side of said pump through a feed pipe which has a portion of its circumference within said accumulation chamber and is provided on said portion with a plurality of passage openings, said feed pipe increasing in diameter in the direction toward its connection with said pump.

3. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communication with the interior of said rotor; and means forming a circumferential accumulation chamber at the outlet end of said rotor, said accumulation chamber being connected with the interior of the rotor and with the suction side of said pump through a feed pipe which has a portion of its circumference within said accumulation chamber and is provided on said circumference portion with a plurality of passage openings.

4. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communication with the interior of said rotor; and means at the outlet end of said rotor forming a circumferential accumulation chamber in communication with the interior of said rotor and with the suction side of said pump, said accumulation chamber being connected with said pump through an annular connection channel formed by two walls spaced from each other and disposed coaxially with said rotor.

5. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communication with the interior of said rotor;

means at the outlet end of said rotor forming a circumferential accumulation chamber in communication with the interior of said rotor and with the suction side of said pump; and a second accumulation chamber for the bubble-rich portion of the liquid, said second accumulation chamber also being in communication with at least one pump.

6. A centrifuge for degasification of a viscous liquid, comprising:

a rotor having inlet means for said liquid at one end and outlet means at the other end;

means for driving said rotor, whereby to create on the inner wall surface of said rotor a film of liquid flowing from said inlet means to said outlet means of the rotor and containing a bubble-poor and a bubble-rich portion of liquid;

said outlet means including means for withdrawal of said bubble-poor and said bubble-rich liquid portions separately;

at least one pump having its suction side in communication with the interior of said rotor;

means at the outlet end of said rotor forming a circumferential accumulation chamber in communication with the interior of said rotor and with the suction side of said pump;

a second accumulation chamber for the bubble-rich portion of the liquid, said second accumulation chamber also being in communication with at least one pump; and a return conduit for the bubble-rich portion of the liquid connected to the discharge of said one pump and being in communication with the interior of the rotor.

7. A centrifuge for the degasifying of a viscous liquid comprising in combination:

a centrifuge rotor with a charging end for the liquid to be gasified and an oppositely disposed discharge end for the degasified liquid so that liquid to be degasified is supplied to the charging end on a wall of the rotor in the form of a flowing film of liquid which flows to the discharge end of the rotor and is divided into a bubble-poor outer layer low in bubbles close to the wall and into a bubble-rich inner layer rich in bubbles floating on the bubble-poor layer;

an outlet wall for the bubble-rich layer axially spaced from the rotor wall and receiving the bubble-rich layer;

an annularly shaped collection chamber at the discharge end of the rotor receiving bubble-poor liquid flowing over the rotor wall;

and at least one pump means arranged rotating with the rotor and located on the periphery of the rotor with said pump means receiving liquid low in bubbles from the collection chamber and pumping said liquid low in bubbles from the chamber so that the liquid may be withdrawn centrally through a stationary withdrawal device.

8. A centrifuge for the degasifying of a viscous liquid constructed in accordance with claim 7:

characterized in that the rotor widens conically from the charging end to the oppositely disposed discharge end.

9. A centrifuge for the degasifying of a viscous liquid constructed in accordance with claim 7:

characterized in that the annularly shaped collection chamber is of a larger diameter than the rotor and has a wall expanding generally radially outwardly from the rotor wall to the chamber.

10. A centrifuge for the degasifying of a viscous liquid constructed in accordance with claim 7:

wherein said outlet wall has an annularly shaped separating edge spaced from the edge of the rotor wall to form a gap for the bubble-poor layer, with means provided for adjusting the location of said edge in an axial direction to change the size of said gap.

11. A centrifuge for the degasifying of a viscous liquid constructed in accordance with claim 7:

wherein said pump means has a radially extending rotor for pumping the liquid radially outwardly.

12. A centrifuge for the degasifying of a viscous liquid constructed in accordance with claim 7:

including means for controlling the rate of operation of said pump means.

13. A centrifuge for the degasifying of a viscous liquid constructed in accordance with claim 7:

wherein said pump means includes a plurality of circumferentially spaced pumps with means for driving said pumps extending coaxially with the rotor and provided with a radial drive connection.

14. A centrifuge for degasification of a viscous liquid comprising in combination:

a rotor having a tapered centrifugal chamber leading from a smaller end to a larger end;

means for driving the rotor in rotation;

an inlet at the smaller end for receiving liquid containing a gas;

an annular gap at the larger end of the rotor leading to a discharge chamber for receiving bubble-poor liquid;

a discharge passage means at the larger end of the rotor for receiving bubble-rich portions of the liquid which do not pass through said gap which can be recirculated through the rotor;

and a pump means rotatable with the rotor having an intake connected to said gap discharge chamber for removing the bubble-poor liquid continually during rotation.

15. A centrifuge for degasification of a viscous liquid constructed in accordance with claim 14:

and including an annular chamber surrounding the pump means and rotatable therewith with a centrally located axial outlet for receiving the liquid pumped by the pump means.

* * * * *